US007048169B2

(12) United States Patent
Sun

(10) Patent No.: US 7,048,169 B2
(45) Date of Patent: May 23, 2006

(54) NAIL MAGAZINE FOR NAILING GUN

(75) Inventor: Pei-Chang Sun, Taichung (TW)

(73) Assignees: Modern Pioneer Ltd. (TW); Pei-Chang Sun (TW)

( * ) Notice: Subject to any disclaimer, the term of this patent is extended or adjusted under 35 U.S.C. 154(b) by 0 days.

(21) Appl. No.: 10/755,385

(22) Filed: Jan. 13, 2004

(65) Prior Publication Data

US 2005/0121488 A1 Jun. 9, 2005

(30) Foreign Application Priority Data

Dec. 5, 2003 (CN) ..... 200320126484

(51) Int. Cl.
*B25C 3/00* (2006.01)

(52) U.S. Cl. ..... 227/120; 227/109; 227/119

(58) Field of Classification Search ..... 227/109, 227/120, 138, 139, 8, 119, 123
See application file for complete search history.

(56) References Cited

U.S. PATENT DOCUMENTS 3,060,439 A * 10/1962 Haubold ..... 227/120
3,633,811 A * 1/1972 Ploen ..... 227/109
5,632,431 A * 5/1997 Lin ..... 227/109
5,692,665 A * 12/1997 Lee ..... 227/109
5,695,108 A * 12/1997 Lee ..... 227/109
5,873,509 A * 2/1999 Liao ..... 227/109
6,715,657 B1 * 4/2004 Chen ..... 227/120
2004/0211810 A1 * 10/2004 Ho et al.

* cited by examiner

*Primary Examiner*—Scott A. Smith
*Assistant Examiner*—Thanh Truong
(74) *Attorney, Agent, or Firm*—Bacon & Thomas PLLC

(57) ABSTRACT

A nail magazine for alternatively accommodating T-nails or U-nails includes a nail track and a stop block. The nailing track has a bottom notch and a first nail hole upwardly extended from the bottom notch for holding a T-nail. The stop block is positioned in the bottom notch of the nailing track and has a top side, a left side and a right side, which define with a peripheral wall of the bottom notch of the nailing track a second nail hole for holding a U-nail. The stop block further has a top cut groove aligned with the first nail hole such that the T-nail held in the first nail hole is in coincidence with an axis of a driving path that aligns with the second nail hole, thereby enabling the T-nail to be positively and straightly driven into a workpiece.

4 Claims, 12 Drawing Sheets

NAIL MAGAZINE FOR NAILING GUN

BACKGROUND OF THE INVENTION

1. Field of the Invention

The present invention relates to nailing guns and, more specifically, to a nail magazine for nailing gun, which is practical for use with T-nails as well as U-nails.

2. Description of the Related Art

Regular nails for use in nailing guns include two types, namely, the T-nails and the U-nails. The nail magazines of regular nailing guns fit only one specific type of nails. Although there are nail magazines capable of accepting T-nails as well as U-nails, however these dual-use nail magazines are still not satisfactory in function.

FIG. 1 is a sectional front-end view of a dual-use nail magazine according to the prior art. According to this design, the dual-use nail magazine comprises a housing 1, a nail guide 2, a T-nail groove 3 and a U-nail groove 4 defined in the housing 1. The longitudinal groove section 3*a* of the T-nail groove 3 forms one side section 4*a* of the U-nail groove 4, i.e., the T-nail groove 3 is biased to one side of the U-nail groove 4 relative to the axis L of the path of the firing pin 5 of the nailing gun. As illustrated in FIG. 1, the whole area of the top side of the U-nail 6 receives compact from the bottom side of the firing pin 5, i.e., the U-nail 6 is evenly forced into the workpiece. When driving a T-nail 7 as shown in FIG. 2, the top side of the T-nail 7 receives impact from only a part of the bottom side of the firing nail 5, i.e., the pressure of the firing pin 5 is not evenly applied to the T-nail 7, and the T-nail 7 tends to be deformed during nailing.

Further, the aforesaid nail magazine is not suitable for accommodating big-size T-nails 7 because excessive long T-nails tend to be deformed during nailing. According to this design, the longitudinal groove section 3*a* of the T-nail groove 3 is made equal to the height 4*a* of the U-nail groove 4. This design limits the application range of the nail magazine.

Therefore, it is desirable to provide a nail magazine that eliminates the aforesaid problems.

SUMMARY OF THE INVENTION

It is therefore the main object of the present invention to provide a nail magazine that fits T-nails as well as U-nails.

It is another object of the present invention to provide a nail magazine that keeps the nails in coincidence with the axis of the path of the firing pin.

It is still another object of the present invention to provide a nail magazine that fits different sizes of T-nails.

To achieve these objects of the present invention, the nail magazine for alternatively accommodating T-nails or U-nails comprises a housing having a receiving chamber therein, a nailing track fastened to a front end of the housing and provided with a bottom notch in alignment with the receiving chamber, a nail guide mounted in the receiving chamber for support nails loaded in the housing, a nail pusher mounted inside the housing for pushing the loaded nails toward the bottom notch of the nailing track, and a stop block. The nailing track further comprises a first nail hole upwardly extended from the bottom notch. The stop block is positioned in the bottom notch of the nailing track. The stop block has a top side, a left side and a right side, which define with a peripheral wall of the bottom notch of the nailing track a second nail hole. The stop block further has a top cut groove downwardly extended from the top side thereof and in alignment with the first nail hole. When T-nails are used and loaded in the housing, the loaded T-nails are forced by the nail pusher to pass through the first nail hole and the top cut groove. When U-nails are used and loaded in the housing, the loaded U-nails are forced by the nail pushers to pass through the second nail hole.

DETAILED DESCRIPTION OF THE INVENTION

Figure 1:
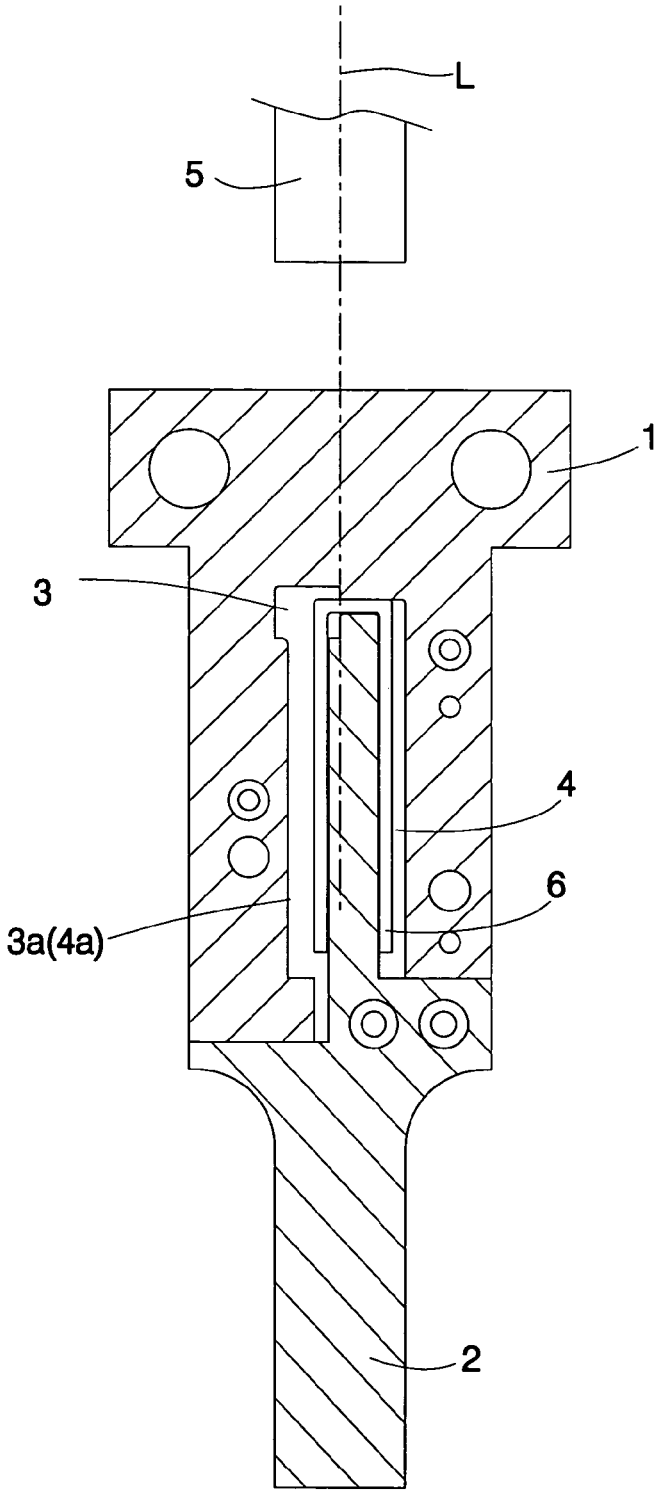
FIG. 1 PRIOR ART
FIG. 1 is a sectional front-end view of a dual-use nail magazine according to the prior art.
Figure 2:
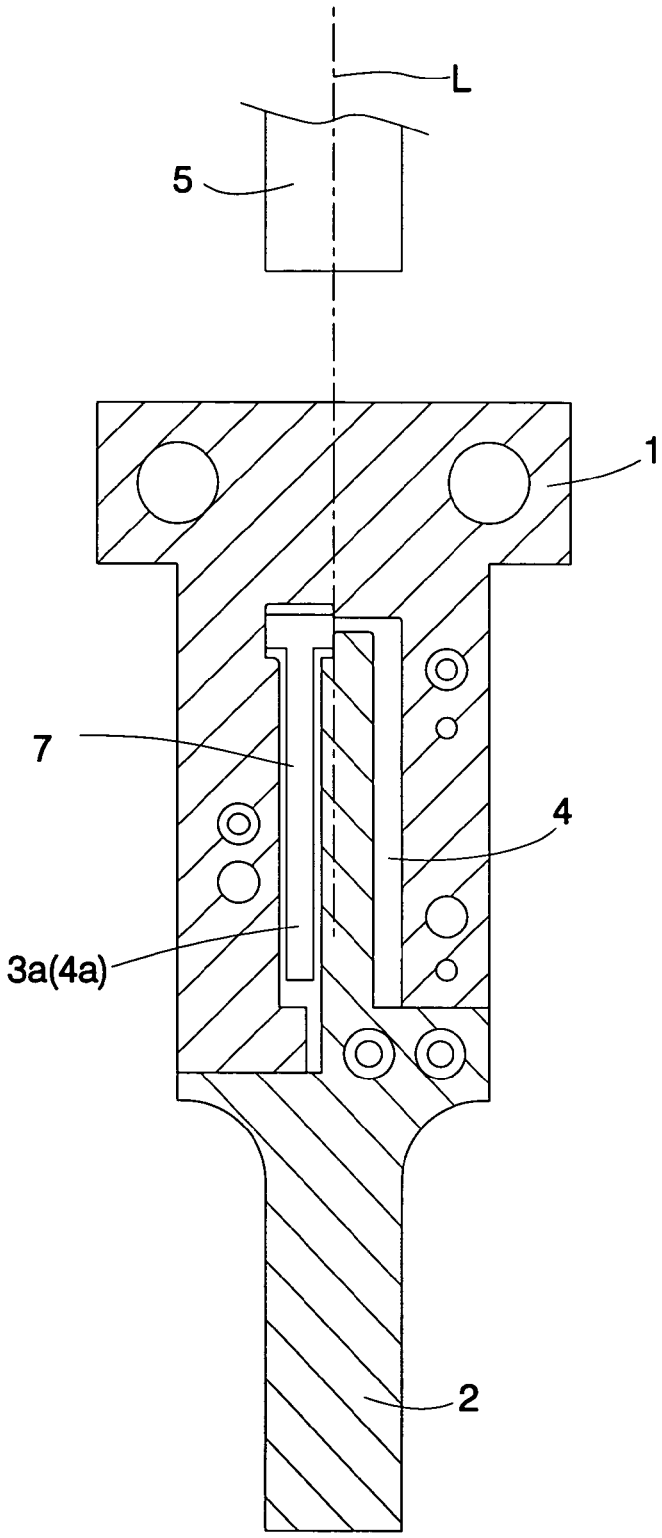
FIG. 2 PRIOR ART
FIG. 2 is similar to FIG. 1 but showing T-nails used instead of U-nails.
Figure 3:
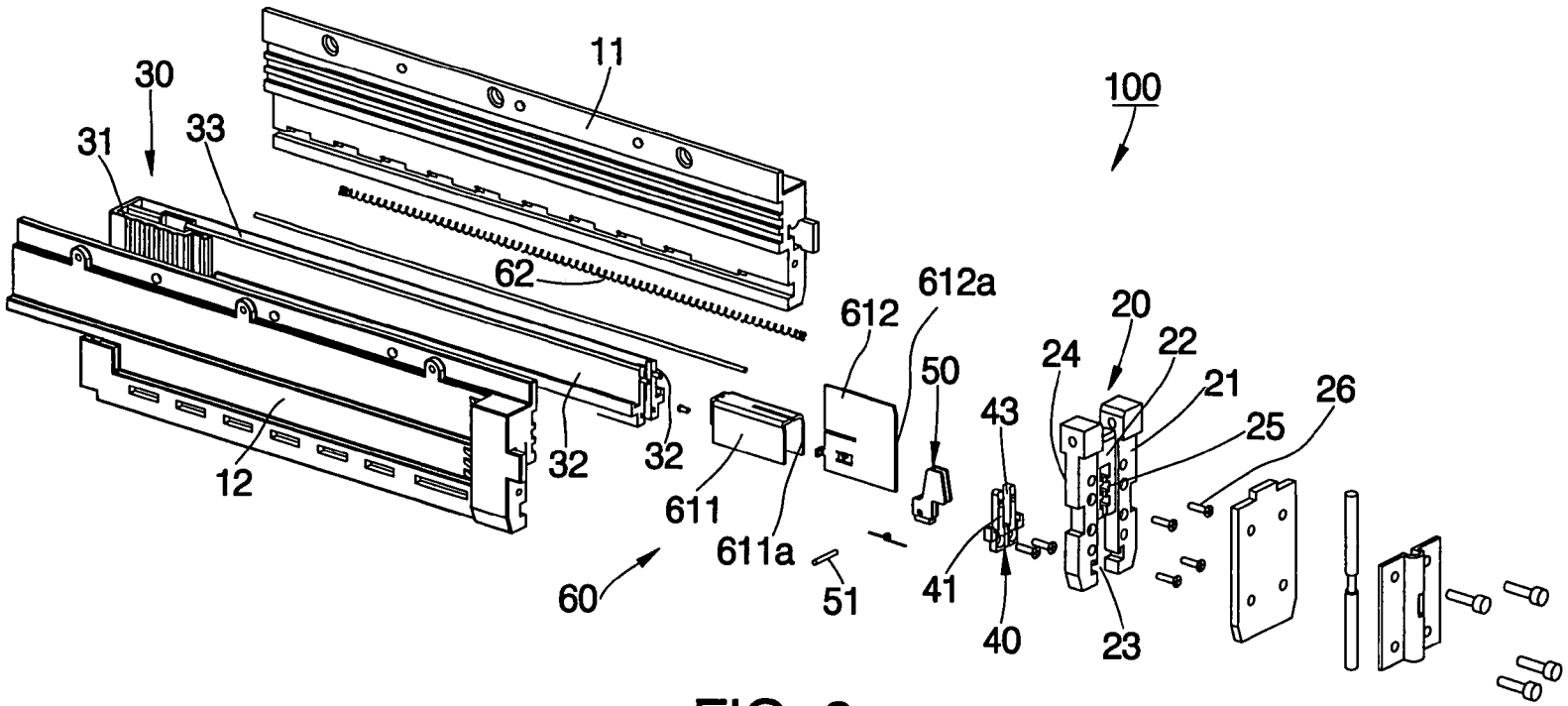
FIG. 3 is an exploded view of a nail magazine according to the present invention.

Referring to FIGS. 3~7, a nail magazine 100 fits T-nails 101 (see FIG. 9) as well as U-nails 102 (see FIG. 12), and the firing pin 103 of the nailing gun (not shown) can smoothly drive the loaded nails out of the nail magazine 100. The nail magazine 100 is comprised of a housing 10, a nailing track 20, a nail guide 30, a stop block 40, a nail clamp 50, and a nail pusher 60.

Figure 4:
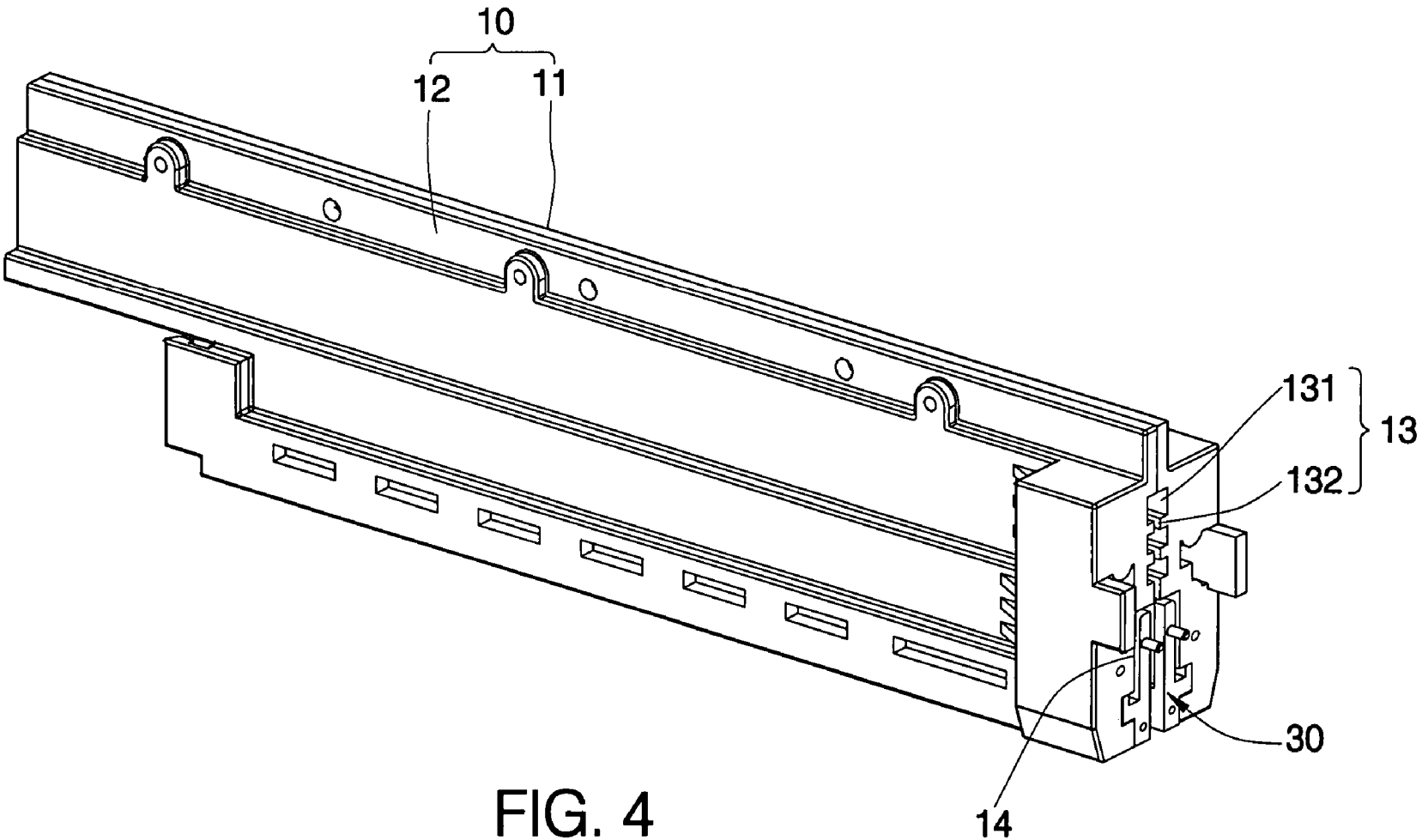
FIG. 4 is a perspective view showing the housing of the nail magazine coupled with the nail guide according to the present invention.

The housing 10 is comprised of flat, narrow, elongated shells 11 and 12 each having a plurality of grooves extended on the respective inner along the length surface such that when the shells 11 and 12 fastened together, as shown in FIG. 4, a T-nail groove 13 is formed in the upper part of the housing 10 and a receiving chamber 14 is formed in the lower part of the housing 10 for accommodating the nail guide 30. The T-nail groove 13 has a plurality of transverse groove sections 131 disposed at different elevations and respectively adapted to accommodate the head 101*a* of one of different sizes of T-nails 101 (see also FIG. 9), and one longitudinal groove section 132 adapted to accommodate the nail body 101*b* of any of the aforesaid different sizes of T-nails 101. The bottom end of the longitudinal groove section 132 is in communication with the aforesaid receiving chamber 14. Further, it is to be understood that the longitudinal groove section 132 of the T-nail groove 13 is disposed in the mid point between the shells 11 and 12 of the housing 10.

Figure 5:
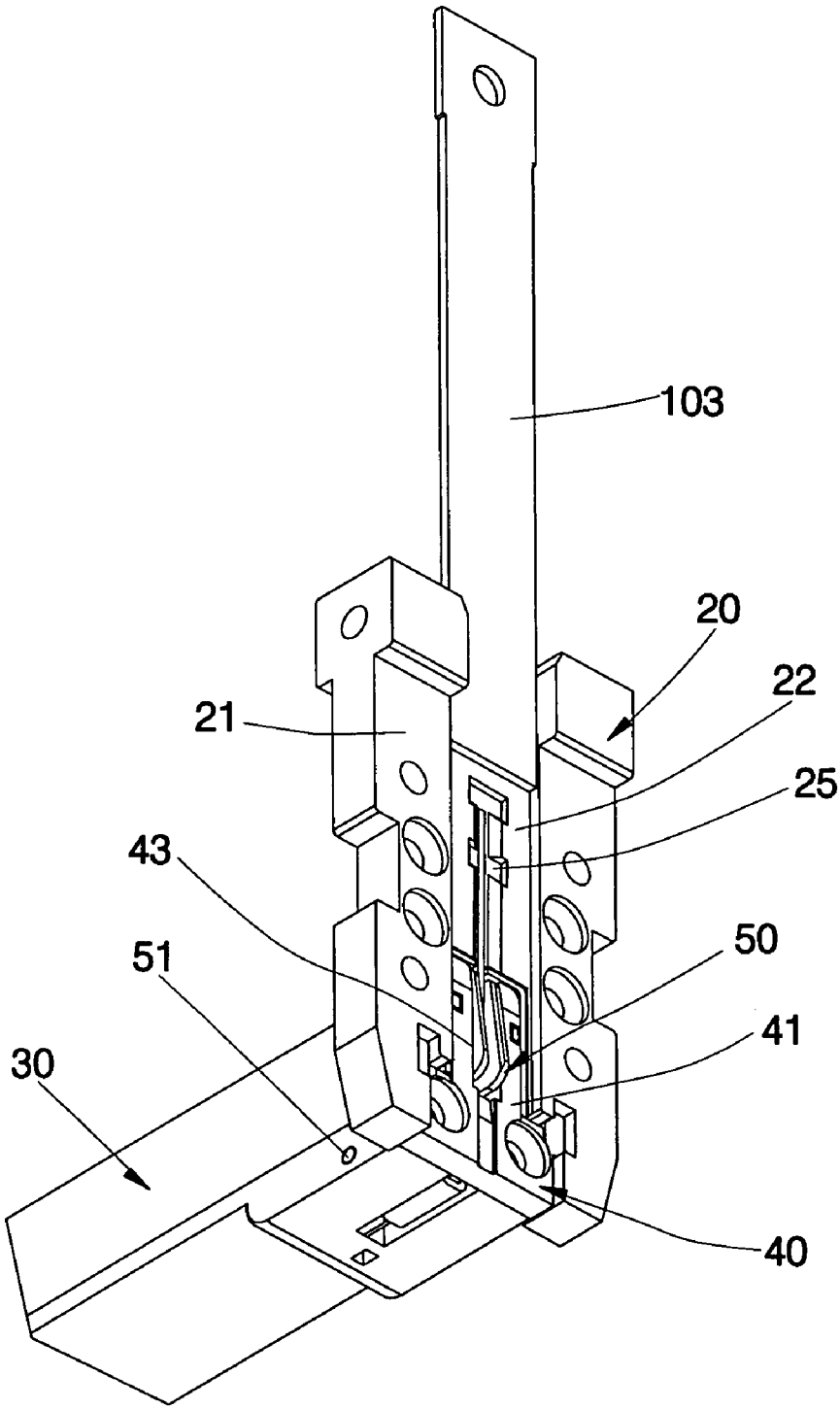
FIG. 5 is a perspective view showing a firing pin coupled to the nailing track of the nail magazine according to the present invention.
Figure 6:
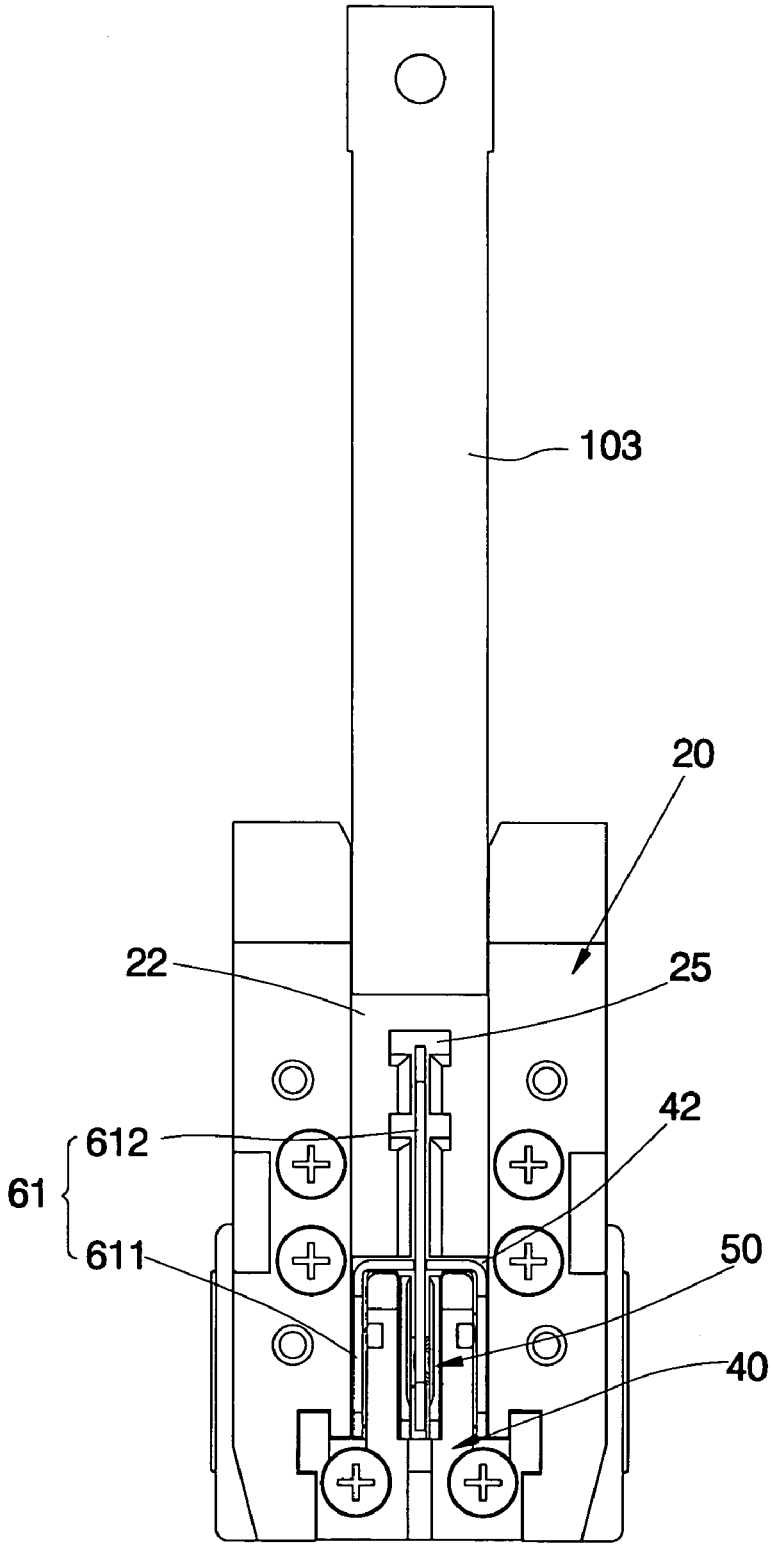
FIG. 6 is a front view of FIG. 5.

The nailing track 20 is fixedly fastened to the front end of the housing 10 with pins 26, as shown in FIGS. 5 and 6. The nailing track 20 comprises a sliding groove 22 longitudinally formed in the front side 21 for guiding vertical movement of the firing pin 103, a bottom notch 23 cut through the front side 21 and the rear side 24 in communication between the bottom end of the sliding groove 22 and the receiving chamber 14, and a first nail hole 25 longitudinally formed in the sliding groove 22 on the middle and upwardly extended from the bottom notch 23. The first nail hole 25 has a profile fitting the transverse groove sections 131 and the longitudinal groove section 132.

The nail guide 30 is a narrow elongated member movable in and out of the aforesaid receiving chamber 14, having a rear finger tip 31 for the holding of the user's hand, two upright sidewalls 32, and a guide groove 33 defined between the upright sidewalls 32. After installation of the nail guide 30 in the housing 10, the guide groove 33 is set in alignment with the longitudinal groove section 132 of the T-nail groove 13. The guide groove 33 is adapted to accommodate the lower part of the nail body 101*b* of a T-nail 101. The two upright sidewalls 32 are adapted to support U-nails 102.

The stop block 40 is fixedly fastened to the front end of the nail guide 30. After installation of the nail guide 30 in the housing 10, the stop block 40 is received in the bottom notch 23 of the nailing track 20, keeping the front side 41 of the stop block 40 in flush with the bottom side of the sliding groove 22, as shown in FIG. 5. As shown in FIG. 6, the top, left and right sides of the stop block 40 define with the peripheral wall of the bottom notch 23 a second nail hole 42 for receiving an U-nail. The stop block 40 further has a top cut groove 43 downwardly extended from the top side in communication with the first nail hole 25.

Figure 7:
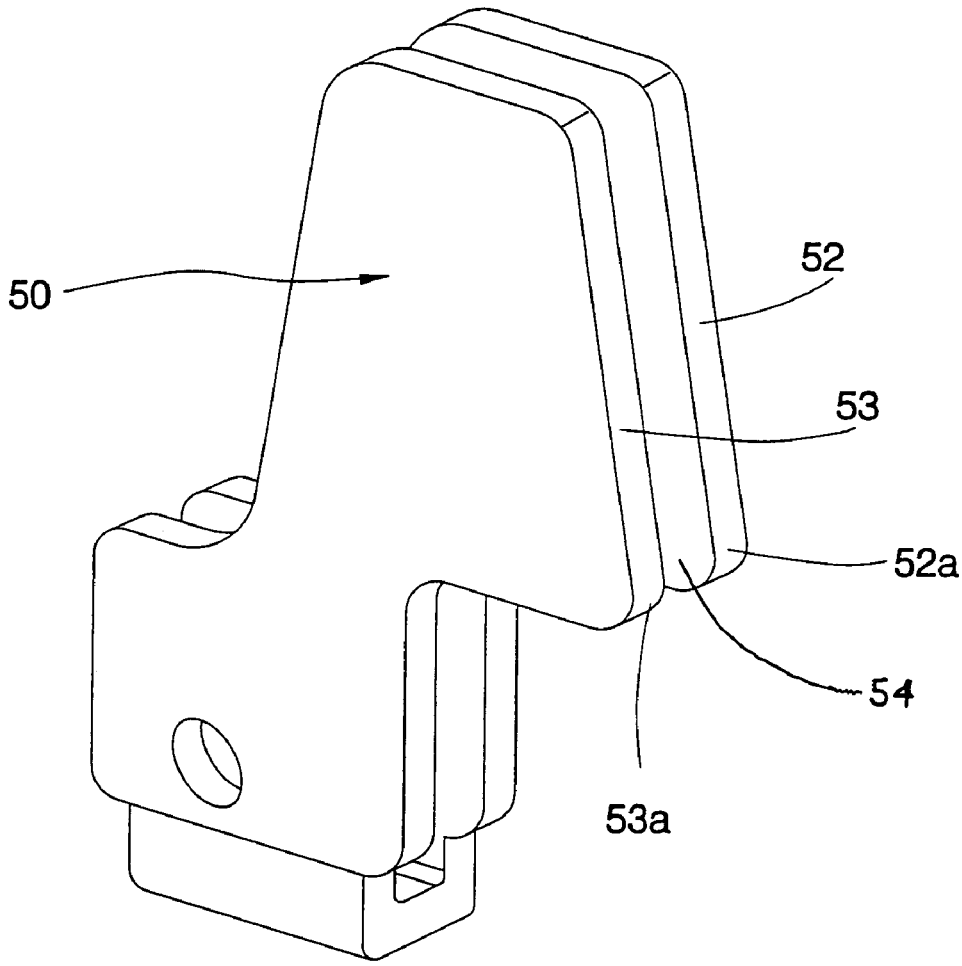
FIG. 7 is a perspective view in an enlarged scale of the clamp shown in FIG. 3.

Referring to FIG. 7, the nail clamp 50 is pivoted to the front end of the nail guide 30 by a pivot pin 51, the nail clamp 50 comprising two parallel clamping walls 52 and 53, the parallel clamping walls 52 and 53 defining a gap 54 therebetween. The clamping walls 52 and 53 each have a front side sloping downwardly forwards. When the nail magazine 100 is assembled, the clamping walls 52 and 53 have the respective front sides inserted into the top cut groove 43 of the stop block 40. As shown in FIG. 5, before down stroke of the firing pin 103, the bottom edges 52*a* and 53*a* of the front sides of the clamping walls 52 and 53 protrude over the front side 41 of the stop block 40. During down stroke of the firing pin 103, the firing pin 103 forces the nail clamp 50 to turn about the pivot pin 51 in one direction and to move to the inside of the cut groove 43, and therefore the nail clamp 50 does not interfere with the firing action of the firing pin 103.

The nail pusher 60 is mounted inside the housing 10, comprising a push member 61 and a spring 62. The push member 61 is comprised of a channel plate 611 and a vertical plate 612. The vertical plate 612 is directly fastened to the channel plate 611. The channel plate 611 is riding on the upright sidewalls 32 of the nail guide 30, having an invertedly disposed U-shaped front push face 611*a*. The vertical plate 612 has the upper part suspended in the longitudinal groove section 132 of the T-nail groove 13, and the lower part suspended in the guide groove 33 of the nail guide 30, having a longitudinal push face 612*a*. The spring 62 is adapted to impart a forward push force to the push member 61, causing the push member 61 to push T-nails 101 or U-nails 102 toward the first nail hole 25 or the second nail hole 42.

Figure 8:
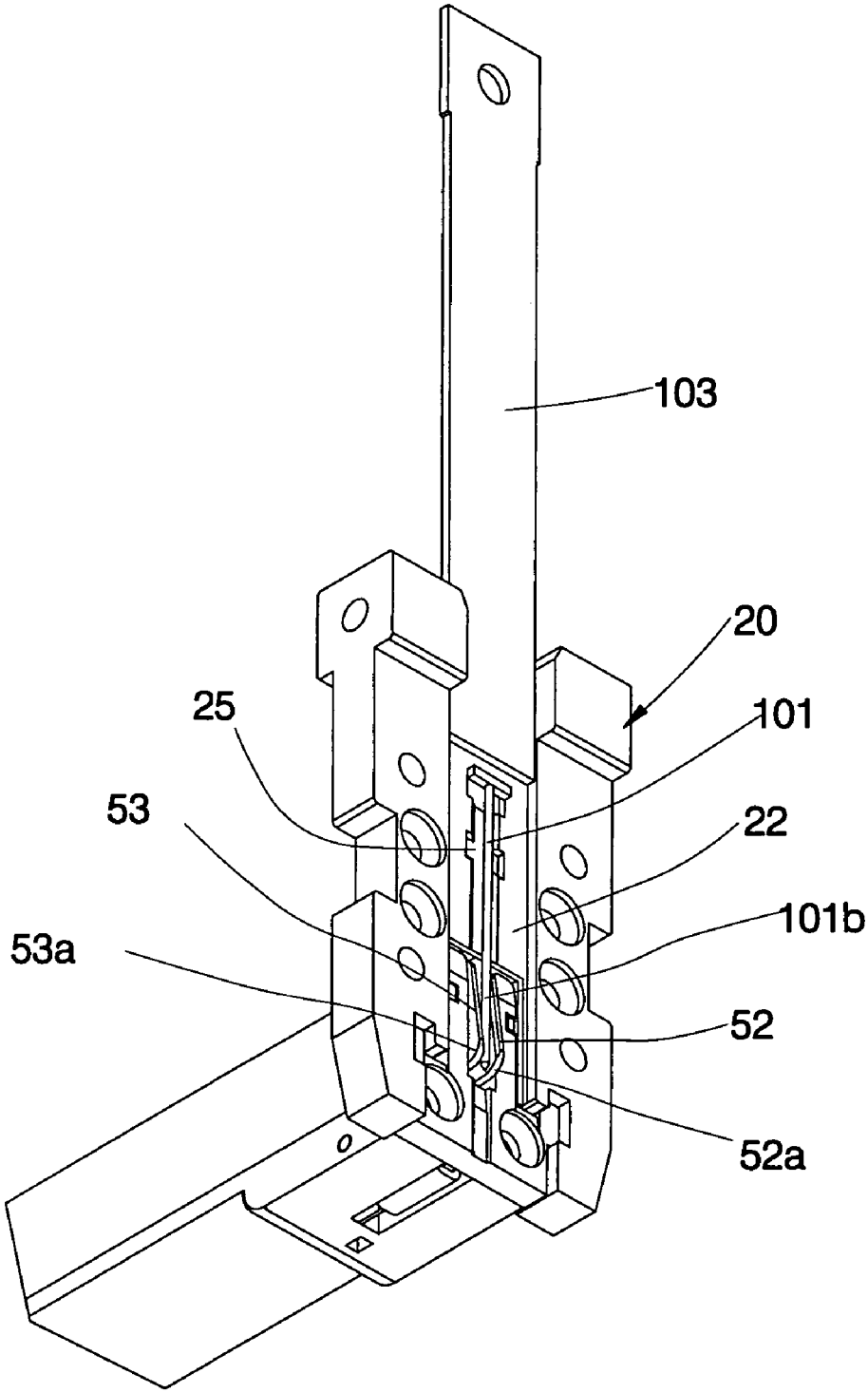
FIG. 8 is similar to FIG. 5 but showing the T-nail in the firing position.
Figure 9:
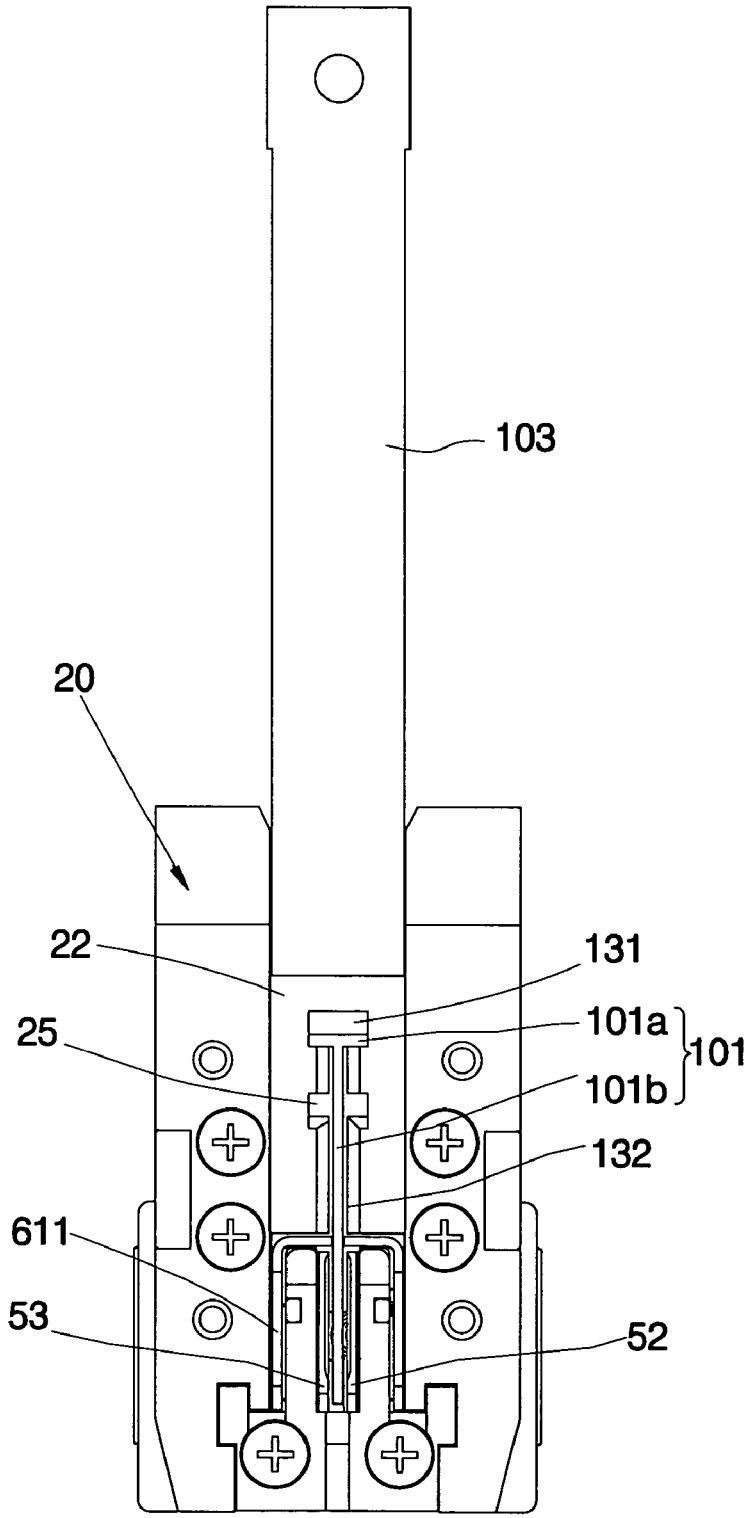
FIG. 9 is a front view of FIG. 8.
Figure 10:
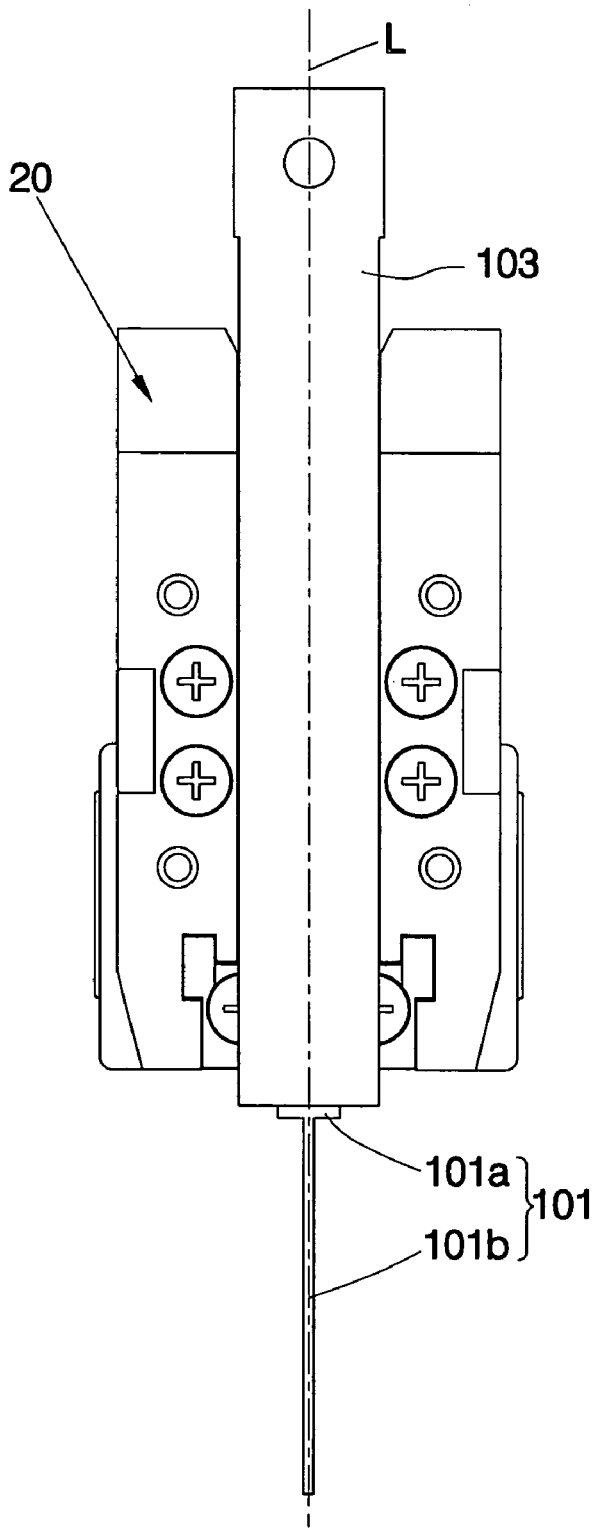
FIG. 10 is similar to FIG. 9 but showing the T-nail driven out of the nail magazine.

The use of the nail magazine 100 with T-nails 101 or U-nails 102 is outlined hereinafter. When T-nails 101 are used and loaded in the nail magazine 100, as shown in FIGS. 8 and 9, they are immediately forced forwards by the longitudinal push face 612*a* of the vertical plate 612 of the nail pusher 60, thereby causing the first T-nail 101 to protrude over the sliding groove 22 of the nailing track 20 through the first nail hole 25 and the gap between the clamping walls 52 and 53, and at the same time the lower part of the body 101*b* of the first T-nail 101 is clamped by the bottom edges 52*a* and 53*a* of the front sides of the clamping walls 52 and 53 of the nail clamp 50. Because the body 101*b* of the T-nail 101 is maintained in coincidence with the axis L of the path of the firing pin 103, as shown in FIG. 10, the T-nail 101 is straightly and positively driven into the workpiece (for example, wooden material) upon down stroke of the firing pin 103.

Figure 11:
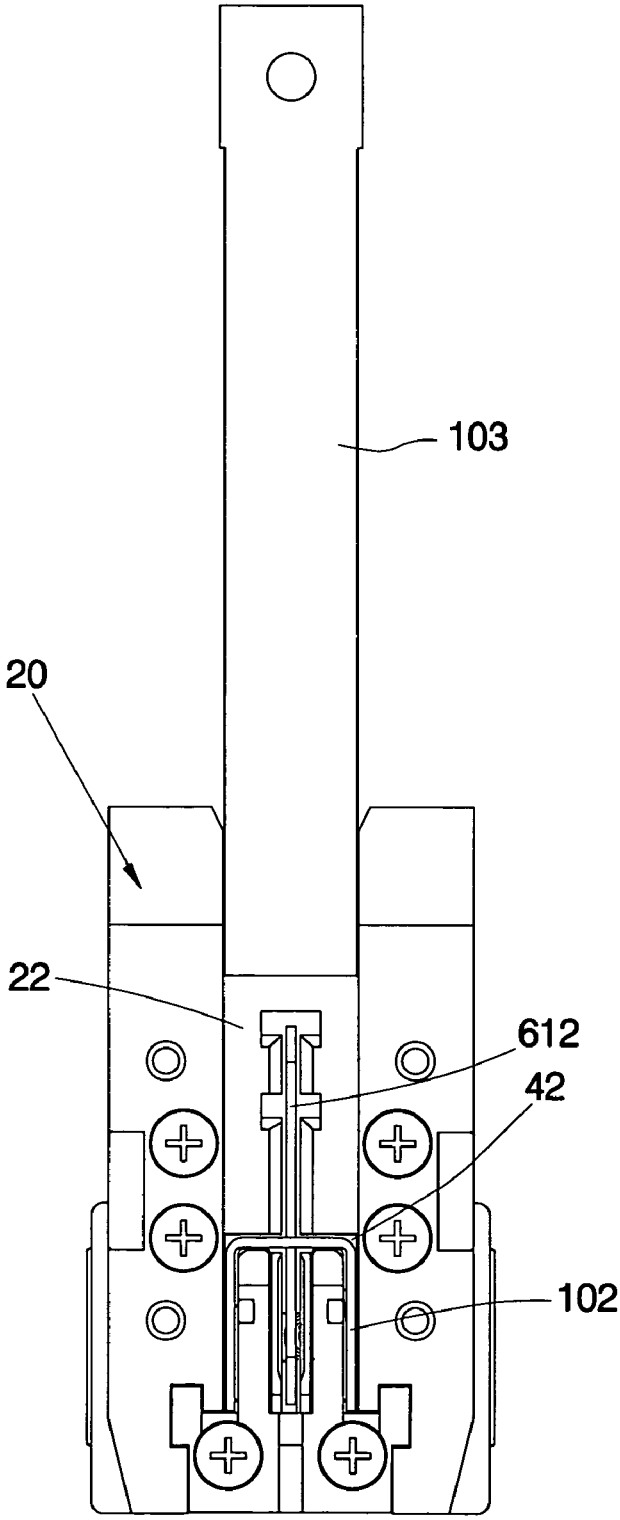
FIG. 11 is similar to FIG. 9 but showing the U-nail in the firing position.
Figure 12:
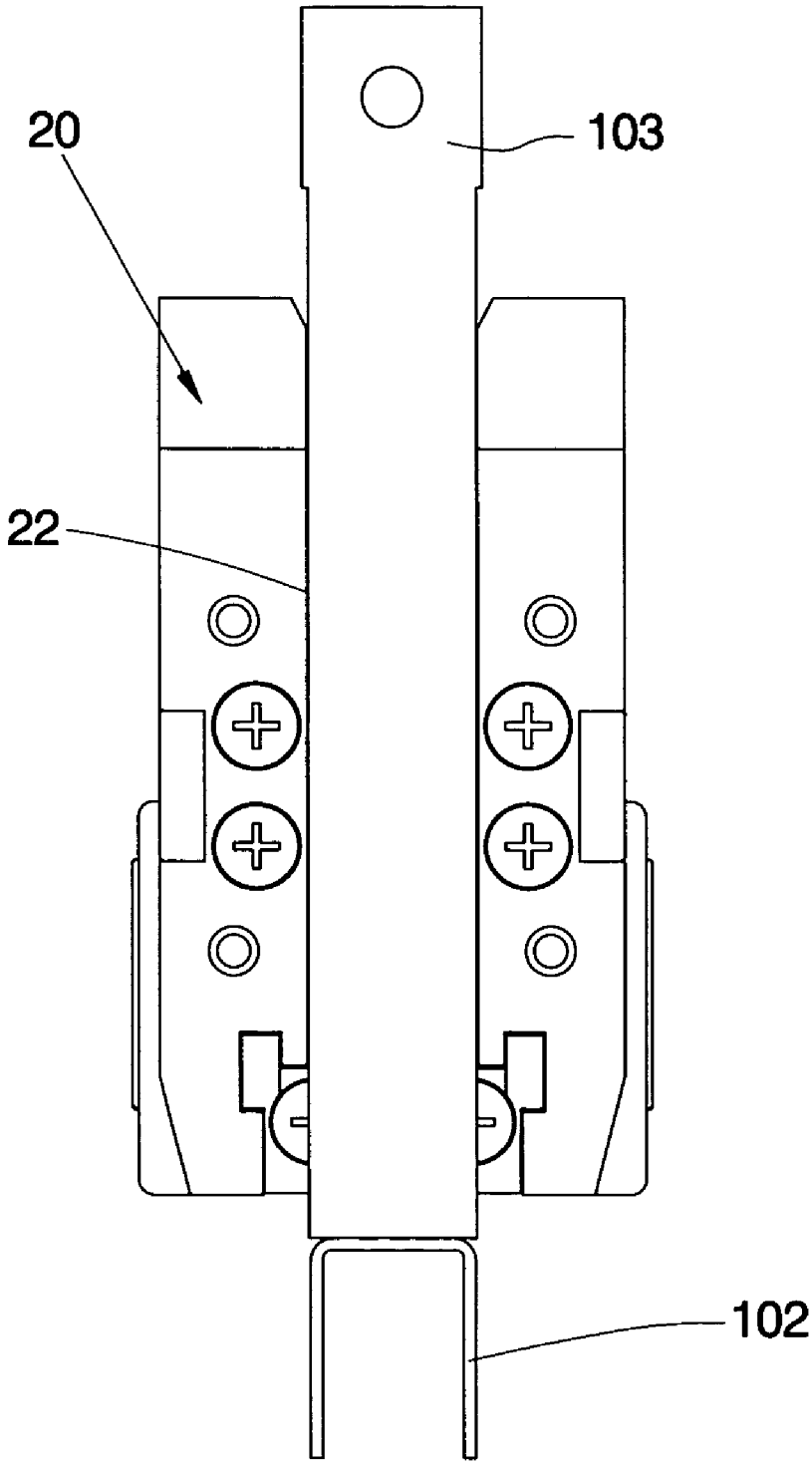
FIG. 12 is similar to FIG. 11 but showing the U-nail driven out of the nail magazine.

When U-nails 102 are used and loaded in the nail magazine 100, as shown in FIG. 11, they are immediately forced forwards by the invertedly disposed U-shaped front push face 611*a* of the channel plate 611, thereby causing the first U-nail 102 to protrude over the sliding groove 22 of the nailing track 20 through the second nail hole 42, and the first U-nail 102 is straightly and rapidly driven into the workpiece upon down stroke of the firing pin 103 (see FIG. 12).

As indicated above, the invention has the following advantages.

1. The nail magazine 100 is suitable for use with T-nails 101 as well as U-nails 102. When T-nails 101 are used, the nail body 101*b* of the T-nail shifted to the firing position is maintained in coincidence with the axis of the path of the firing pin 103, and therefore the T-nail can straightly and positively be driven into the workpiece.

2. When T-nails 101 are used and loaded in the nail magazine 100, the nail clamp 50 holds the nail body 101*b* of the T-nail 101 in the firing position for driving by the firing pin 103, and is smoothly turned away from the path of the firing pin 103 for enabling the T-nail 101 to be driven into the workpiece straightly and positively upon down stroke of the firing pin 103.

3. The nail magazine 100 fits T-nails of different sizes, more particularly T-nails of length greater than the height of the U-nails.

What is claimed is:

1. A nail magazine for alternatively accommodating T-nails or U-nails, comprising:

an elongated housing having a receiving chamber therein;

a nailing track fastened to a front end of said housing and having a bottom notch in communication with said receiving chamber;

a nail guide mounted in said receiving chamber for supporting nails loaded in said housing;

a nail pusher mounted inside said housing for pushing said loaded nails along said nail guide toward said bottom notch of said nailing track;

wherein said nailing track further comprises a first nail hole upwardly extended from said bottom notch;

a stop block positioned in said bottom notch of said nailing track, said stop blocking having a top side, a left side, and a right side, and a top cut groove downwardly extended from said top side and in communication with said first nail hole, the top, left and right sides of said stop block defining with a peripheral wall of said bottom notch of said nailing track a second nail hole; and a nail clamp pivoted to a front end of said nail guide, comprising two parallel clamping walls defining a gap therebetween, said clamping walls each having a front side extending into said top cut groove of said stop block, the nail clamp being configured and arranged to hold the body of a front T-nail between said clamping walls wherein when T-nails are used and loaded in said housing, the loaded T-nails are forced by said nail pusher to pass through said first nail hole and said top cut groove, and when U-nails are used and loaded in said housing, the loaded U-nails are forced by said nail pushers to pass through said second nail hole.

2. The nail magazine as claimed in claim 1, wherein said housing comprises a T-nail groove formed therein above said receiving chamber, said T-nail groove having a transverse groove section and a longitudinal groove section; said first nail hole of said firing track has a profile corresponding to said transverse groove section and said longitudinal groove section of said T-nail groove; said nail guide comprises two upright sidewalls arranged in parallel, and a guide groove defined between said upright sidewalls and set in alignment with the longitudinal groove section of said T-nail groove; said nail pusher comprises a follower spring and a push member forced by said follower spring to push the loaded nails, said push member of said nail pusher having a U-shaped front push face riding on said upright sidewalls of said nail guide, and a longitudinal push face, said longitudinal push face having an upper part disposed in the longitudinal groove section of said T-nail groove and a lower part disposed in said guide groove of said nail guide.

3. The nail magazine as claimed in claim 2, wherein said nailing track comprises a sliding groove longitudinally formed in a front side thereof; said first nail hole, is longitudinally formed on a middle of said sliding groove; said stop block is affixed to said front end of said nail guide and disposed in said bottom notch of said nailing track, said stop block having a front side maintained in flush with a bottom side of the sliding groove of said nailing track.

4. The nail magazine as claimed in claim 1, wherein said clamping walls of said nail clamp each have a sloping front side sloping downwardly forwards, the sloping front sides of said clamping walls each having a bottom edge protruding over a front side of said stop block to support the front T-nail for nailing, said nail clamp being turned inwards and received in said top cut groove of said stop block upon firing of the front T-nail.

* * * * *